United States Patent [19]

Ketterer et al.

[11] 4,094,261

[45] June 13, 1978

[54] ADJUSTABLE NEEDLE GUARD

[75] Inventors: Stanley J. Ketterer, Jamesburg; William J. Edwards, Cranbury, both of N.J.

[73] Assignee: The Singer Company, New York, N.Y.

[21] Appl. No.: 779,957

[22] Filed: Mar. 22, 1977

[51] Int. Cl.[2] ..... D05B 55/06

[52] U.S. Cl. ..... 112/228

[58] Field of Search ..... 112/228, 181, 184, 227, 112/231; 403/7, 290, 297

[56] References Cited

U.S. PATENT DOCUMENTS

| | | | |
|---|---|---|---|
| 2,883,953 | 4/1959 | Johnson | 112/184 |
| 3,023,721 | 3/1962 | Johnson | 112/184 |
| 3,215,105 | 11/1965 | Kuhar | 112/228 |
| 3,232,258 | 2/1966 | Gegauf, Jr. | 112/228 |
| 3,374,755 | 3/1968 | Chaplin, Jr. | 112/184 X |
| 3,462,893 | 8/1969 | Kaiser | 403/7 X |
| 3,762,350 | 10/1973 | Starnes | 112/231 |
| 3,955,519 | 5/1976 | Weisz | 112/228 |
| 3,977,800 | 8/1976 | Cassel | 403/297 X |

*Primary Examiner*—Werner H. Schroeder
*Assistant Examiner*—Moshe I. Cohen
*Attorney, Agent, or Firm*—Edward L. Bell; Robert E. Smith; J. Falk

[57] ABSTRACT

This disclosure relates to needle guards for rotary loop takers in sewing machines and has its purpose prevention of interference between the needle and the loop seizing beak of the rotary loop taker during the sewing operation. A needle guard is provided which takes the form of a rib member formed in the bottom wall of the rotary loop taker which rib member is spaced from the vertical side wall of the cup-shaped rotary loop taker. The rib member is relatively thin and may be said to be resilient. Means are provided for biasing the rib member toward and away from the vertical side wall of the rotary loop taker in order that the rib member may be adjusted relative to the reciprocating path of the needle so that the needle will be deflected away from the loop seizing beak of the rotary loop taker upon penetration of the fabric by said needle and thereby prevent a scoring of the loop seizing beak or a breakage of the needle.

4 Claims, 4 Drawing Figures

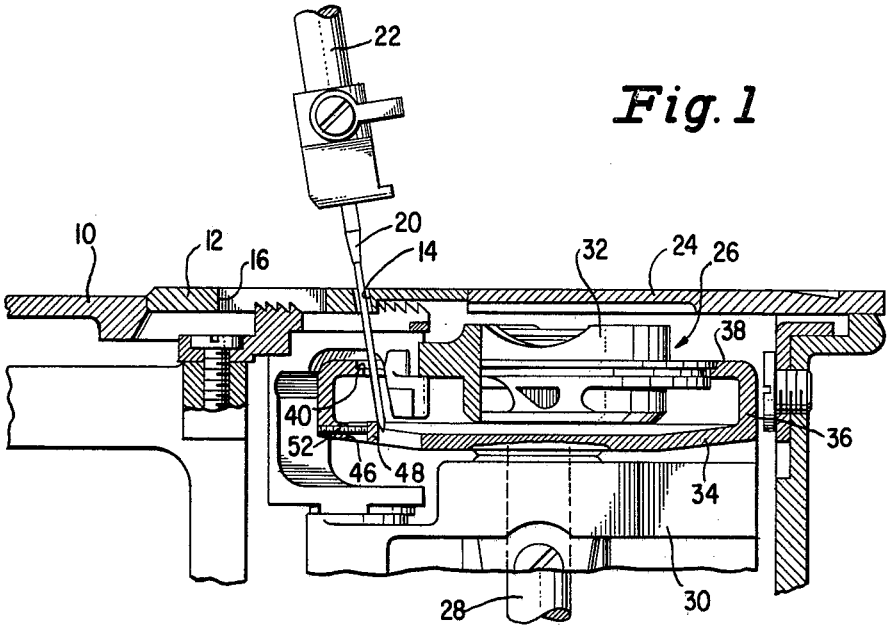
Fig. 1
Fig. 2
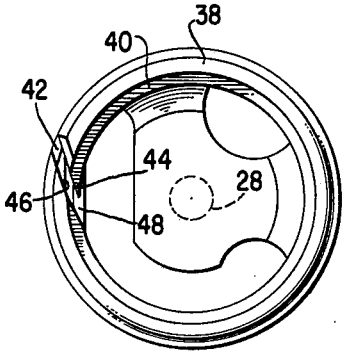
Fig. 3
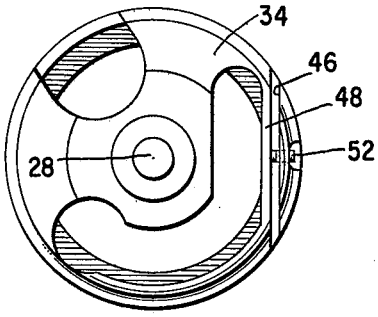
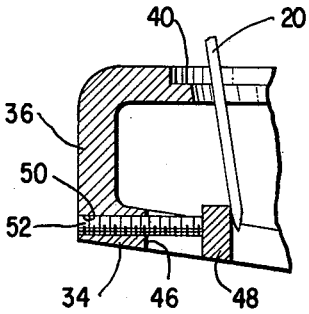
Fig. 4

ADJUSTABLE NEEDLE GUARD

BACKGROUND OF THE INVENTION

This invention relates to needle guards for sewing machines and more particularly to a device for preventing interference between the needle and the loop seizing beak of the rotary loop taker during the sewing operation. As is known, the needle will follow a reciprocatory path during the sewing operation and the needle will pass in close proximity to the beak of the rotary loop taker. In the event that the needle may become bent or deflected by irregularities in the material and such, the needle may strike the beak of the rotary loop taker and result in a scoring of the beak or a breakage of the needle. It is known in the art to provide needle guards for preventing these occurrences which needle guards are inserted during the assembly of the machine and are adjusted along with the loop taker to provide the proper angular relationship between the hook, the needle guard and the needle. It is also known to provide fixed needle guards which are inserted after formation of the rotary loop taker, which type of needle guards require substantial machining of the rotary loop taker as well as assembly time. It is also known to provide other types of adjustable needle guards such as those formed by wires or the like inserted in the rotary loop taker, as for example shown in U.S. Pat. No. 3,955,519, issued on May 11, 1976, issued to the same Assignee as the present invention. Reference should also be made to U.S. Pat No. 2,883,953, issued on Apr. 28, 1959, for another loop taker needle guard of the type referred to above.

Although the needle guards of the prior art referred to above, as well as others, have operated substantially satisfactorily, they very often require accuracy in machining and substantial assembly time during assembly of the sewing machine. In accordance with the present invention, a needle guard is provided which is formed by relatively simple machining of the rotary loop taker and which does not require a great degree of accuracy. The needle guard is adjustable so as to provide for discrepancy between the relationship of the needle in its operating path and the loop seizing beak so as to prevent any interference between these elements.

GENERAL DESCRIPTION OF THE INVENTION

The present invention comprises in general a needle guard for a rotary loop taker for preventing interference between the needle and the loop seizing beak of the rotary loop taker. The needle guard of the present invention is formed by machining the bottom wall of the cup-shaped rotary loop taker so as to leave a relatively thin and resilient rib spaced from the vertical side wall of said rotary loop taker. The rib member is spaced from said vertical side wall by a slot between the rib member and the vertical side wall and permits relative movement or flexing of the rib member so as to enable the rib member to be adjusted a sufficient amount to account for any discrepancies in the path of travel of the needle during its reciprocation such as may be caused by irregularities in the material or in the event the needle becomes bent or the like. The adjustment means for the rib member is relatively simple in nature, as will be apparent hereafter, and in general comprises a tapped bore in a side wall of the cup-shaped rotary loop taker into which is inserted a screw member which may be brought to bear against a side wall of the rib member so as to bias it away from the vertical side wall of the rotary loop taker or to permit it to return towards said vertical side wall. It will be apparent from the following detailed description of the invention that the needle guard of the invention is relatively simple in construction, is easily manufactured and does not require a high degree of accuracy in the machining since the needle guard is readily adjustable.

Upon reading the following detailed description of the invention, the objects and advantages of the invention will become readily apparent particularly when reading the said detailed description with the accompanying drawings.

BRIEF DESCRIPTION OF THE DRAWINGS

FIG. 1 is a vertical sectional view taken through the base of a lock stitch sewing machine incorporating the present invention therein.

FIG. 2 is a top plan view of the rotary loop taker illustrated in FIG. 1 taken on a smaller scale.

FIG. 3 is a bottom plan view of the rotary loop taker shown in FIG. 2.

FIG. 4 is an enlarged fragmentary vertical sectional view of a portion of the rotary loop taker and illustrating the needle guard of the present invention.

DETAILED DESCRIPTION OF THE INVENTION

Referring to FIG. 1, a portion of a sewing machine is shown therein as including a base 10 supporting a throat plate 12 which includes a needle aperture 14 and slots 16 for reciving the feed dog 18 of a feed mechanism in order to feed a material across the throat plate 12 in a right to left direction as viewed in FIG. 1. A needle 20 is suitably supported in a needle bar 22 for reciprocation in an endwise operating path such that said needle 20 passes through the material and the needle aperture 14 in said endwise reciprocation in a known manner. A slide plate 24 is also supported on the base 10 and is removable to permit access to the loop taker 26. The loop taker 26 is supported on a loop taker shaft 28 which shaft 28 is suitably connected to a driving mechanism (not shown) for rotating the loop taker also in a known manner. The shaft 28 is supported for rotation in a bearing 30 which is suitably supported in the machine frame. A thread carrying case or bobbin 32 is supported in the loop taker for carrying a supply of thread for cooperation with the needle thread to form lock stitches as is customary in lock stitch sewing machines. The mechanism thus far described is conventional in sewing machines and reference may be made to U.S. Pat. No. 3,023,721, issued Mar. 6, 1962, for a description of the mechanism thus far described.

With further reference to the drawings, the loop taker as shown is substantially cup-shaped and comprises a bottom wall 34, a vertically extending side wall 36, and a laterally extending top wall 38, which extends in a direction toward the center of the loop taker 26. As shown, in particular in FIG. 2, the top wall 38 is in the form of an annular ring and is provided with an annular rib 40 extending laterally inwardly from the inner peripheral surface thereof. The top wall 38 and the rib 40 are provided with a cut-out portion 42 in the form of a narrow channel to form at the radially inward side of the annular rib 40 a loop seizing beak 44. The loop seizing beak 44 is located on the loop taker so as to cooperate with the needle 20 during the endwise reciprocatory motion of the needle such that the loop seizing beak will seize a loop of thread from the needle and form stitches in a known manner.

During the sewing operation, due to irregularities in the fabric or due to various conditions which may cause a deflection of the needle, there may be a problem in that at times the line of needle penetration could be such that the needle will not follow the desired needle operating path and will interfere with the loop seizing beak and thus cause damage to the loop seizing beak or the needle itself. In order to prevent such occurrences, a needle guard is provided which needle guard is displaced radially inwardly from the loop seizing beak and substantially immediately beneath said loop seizing beak with respect to direction of needle penetration so as to engage or contact the needle and prevent it from striking said loop seizing beak.

Referring in particular to FIGS. 3 and 4, it will be seen that the bottom wall 34 of the loop taker 26 is formed with a slot 46 extending therethrough and from one portion of the circumferential surface of the loop taker 26 to another so as to cut across an arc formed by the outer circumferential surface of said loop taker. Spaced radially inwardly from the slot 46 is a rib-like needle guard member 48 which extends parallel to the slot 40. As best seen in FIG. 4, the needle guard rib 48 is formed in the bottom wall 34 so as to be positioned immediately adjacent the path of the reciprocating needle 20. Further, the needle guard rib 48 is formed with a relatively thin cross section so that it may be said that the needle guard rib 48 is resilient. Being that the needle guard rib 48 is resilient, it may be bent so as to alter its position relative to the needle path. In order to alter or adjust the relative position of the needle guard rib 48, a bore 50 is provided through the loop taker side wall 36 and extends in a direction toward the needle guard rib 48. The bore 50 is tapped so that a threaded set screw 52 may be inserted therein and may be threaded toward and away from the needle guard rib 48. Thus, by turning the set screw 52 inwardly with respect to bore 50 and against the needle guard 48, the needle guard 48 may be displaced radially inwardly with respect to the axis of the loop taker 26 or the set screw 52 may be turned outwardly away from the needle guard 48 so as to permit the resilient needle guard rib member 44 to return toward a position radially outwardly from the center of the loop taker 26. Thus, when the sewing machine is set up, the operator or mechanic may relatively easily adjust the relative position of the needle guard rib member 48 with respect to the operating path of the needle 20 so that as the needle is descending it will be deflected away from the loop seizing beak 44 and thus prevent injury to the loop seizing beak 44 or to the needle 20 itself. As will be apparent, the formation of the needle guard rib member 48 is relatively simple in that it only requires a machining of the bottom wall 34 of the loop taker to leave the relatively thin cross section needle guard rib member in the desired position. Thus no additional structure or assembly is required in the provision of the needle guard of the invention except for the provision of set screw 52.

From the above detailed description, it will be apparent that the present invention provides a novel, simple and efficient needle guard means for preventing injury to the loop seizing beak and/or the needle of a sewing machine. As stated above, the needle guard of the invention is simple in construction and relatively easy to manufacture and does not require any substantial amount of assembly time. While the invention has been described in its preferred embodiment, it will be obvious to those skilled in the art that various modifications and changes may be made without departing from the spirit and scope of the invention as defined in the appended claims.

Having thus described the nature of the invention, what is claimed is:

1. A rotary loop taker for a sewing machine having a reciprocatory needle operating in a path for cooperating with said loop taker, said loop taker including a cup-shaped body formed by a bottom wall, a vertical side wall extending from said side wall, a loop seizing beak formed in said annular wall, a resilient rib member formed in said bottom wall, said rib member being spaced from said vertical side wall and disposed at a location substantially beneath said loop seizing beak, and means for deflecting said rib member away from said vertical side wall for adjusting the position of said rib member relative to the operating path of said needle and causing the rib member to be in a position for deflecting the needle away from said loop seizing beak.

2. A rotary loop taker for a sewing machine as recited in claim 1 wherein said rib member extends across an arc formed by the outer circumferential surface of said rotary loop taker.

3. A rotary loop taker for a sewing machine as recited in claim 2 further comprising a slot formed in said bottom wall and extending parallel to said rib member, said slot being disposed intermediate of said rib member and the outer circumferential surface of said rotary loop taker.

4. A rotary loop taker for a sewing machine as recited in claim 1 wherein said means for biasing said rib member toward and away from said vertical side wall comprises screw means disposed for threading toward and away from a side wall of said rib member such when said screw means is threaded toward and away from said rib member the relative position of said rib member is changed with respect to the operating path of said needle.

* * * * *